US005222877A

United States Patent [19]

Benschop et al.

[11] Patent Number: 5,222,877

[45] Date of Patent: Jun. 29, 1993

[54] MOTOR-COMPRESSOR UNIT

[75] Inventors: Antonius A. J. Benschop, Eindhoven; Johannus C. M. Roelofs, Valkenswaard, both of Netherlands

[73] Assignee: U.S. Philips Corporation, New York, N.Y.

[21] Appl. No.: 840,613

[22] Filed: Feb. 20, 1992

Related U.S. Application Data

[63] Continuation of Ser. No. 613,349, Nov. 13, 1990, abandoned.

[30] Foreign Application Priority Data

Nov. 14, 1989 [NL] Netherlands ..... 8902806

[51] Int. Cl.[5] ..... F04B 35/04; F04B 39/12

[52] U.S. Cl. ..... 417/410; 417/435; 417/439; 417/534

[58] Field of Search ..... 417/410, 415, 418, 434, 417/435, 439, 502, 503, 534, 535, 536, 537

[56] References Cited

U.S. PATENT DOCUMENTS 3,828,558 8/1974 Beale ..... 92/172 X
3,937,600 2/1976 White ..... 417/418 X
4,067,667 1/1978 White ..... 417/418
4,407,252 10/1983 Dilliner ..... 417/534 X
4,750,871 6/1988 Curwen ..... 417/418
4,810,915 3/1989 Lissenburg et al. ..... 310/37

FOREIGN PATENT DOCUMENTS 493547 6/1953 Canada ..... 417/534

*Primary Examiner*—Leonard E. Smith
*Attorney, Agent, or Firm*—Brian J. Wieghaus

[57] ABSTRACT

A motor compressor unit comprises a hermetically sealed housing, a vibration motor with a rotationally vibrating drive shaft, and a symmetrical twin free-piston compressor comprising two oppositely disposed identical free pistons which can be reciprocated in respective cylinders by the drive shaft. In order to minimize piston drift from the center position, each cylinder is formed with a duct connecting the respective compression space to the space between the housing and the motor-compressor where the suction pressure prevails, which ducts are situated at equal distances from the respective cylinder end walls and can be closed by the respective pistons. As a result of this, the pressure in both cylinders is built up with the same swept volume and piston drift is minimized.

2 Claims, 1 Drawing Sheet

MOTOR-COMPRESSOR UNIT

This is a continuation of application Ser. No. 07/613,349, filed Nov. 13, 1990, now abandoned.

BACKGROUND OF THE INVENTION

The invention relates to a motor-compressor unit comprising a hermetically sealed housing, a vibration motor having a rotationally vibrating drive shaft, and a symmetrical twin piston compressor comprising two oppositely disposed identical pistons, which can be reciprocated in respective cylinders by the drive shaft to influence a respective compression space, having cylinder end walls which each bound the respective compression spaces and which each comprise inlet and outlet valves.

Such a motor-compressor is known from U.S. Pat. No. 3,937,600.

A problem associated with motor-compressors of this type is "drifting" of the piston, i.e. the piston drifts away from its center position, causing the piston to run asymmetrically and the efficiency to be reduced.

This problem also occurs in refrigerating machines with a single free piston as described in U.S. Pat. No. 3,828,588. In these machines piston drift is caused by a leakage flow of the work medium along the piston from the compression space to a buffer space and vice versa. Drifting is then mitigated by means of a system of ducts which establish a connection between the compression space and the buffer space at specific instants.

U.S. Pat. No. 3,937,600 relates to a motor-compressor and provides a solution to preclude an excessive piston stroke as a result of a decreasing resonant frequency of the mass-spring system, which may lead to collision of the piston against the cylinder end wall (overstroke prevention). For this purpose the compressor is provided with a gas-spring cylinder at both ends. When the piston stroke becomes too large medium will flow from the surrounding to the relevant gas-spring cylinder via a duct system in an extreme position of a piston, thereby causing the stiffness of this gas spring to increase. As this results in a difference in stiffness of the two gas springs the pressures in the gas-spring cylinders are balanced in the piston centre position by temporarily interconnecting the gas-spring cylinders via ducts and the space within the double piston. The spring stiffness of the entire mass-spring system and hence the resonant frequency increases until a normal stroke length is attained again. This compressor is of an intricate construction and should be manufactured with a high accuracy in order to achieve the desired goal.

It is an object of the invention to minimise piston drifting in a simple way in a motor-compressor unit of the type defined in the opening paragraph.

SUMMARY OF THE INVENTION

To this end the motor-compressor unit in accordance with the invention is characterized in that each cylinder is formed with a duct connecting the respective compression space to the space between the housing and the motor-compressor where the suction pressure prevails, which ducts are situated at equal distances from the respective cylinder end walls and can be closed by the respective pistons.

As a result of this symmetrical arrangement of the ducts the pressure build-up is effected at the same swept volume in both cylinders. Drift reduction is now achieved in that in the case that the piston drifts out of the centre position the piston is subjected to a resultant average gas force which is opposed to the drift direction. Therefore, no additional spring action (gas springs or mechanical springs) is needed to provide drift compensation.

The limits imposed on the location of each duct are dictated by a position of the end face of the piston when this piston occupies a center position and by a position of the end face of the piston when this piston occupies a maximal extreme position at the end of a piston stroke.

Preferably, each duct is disposed at a location where the end face of the piston is situated when this piston has reached an extreme position at the end of a piston stroke and when the compressor has pumped a desired minimum amount of medium.

BRIEF DESCRIPTION OF THE DRAWINGS

An embodiment of the invention will now be described in more detail, by way of example, with reference to the accompanying drawing. In the drawing

DESCRIPTION OF THE PREFERRED EMBODIMENTS

Figure 1:
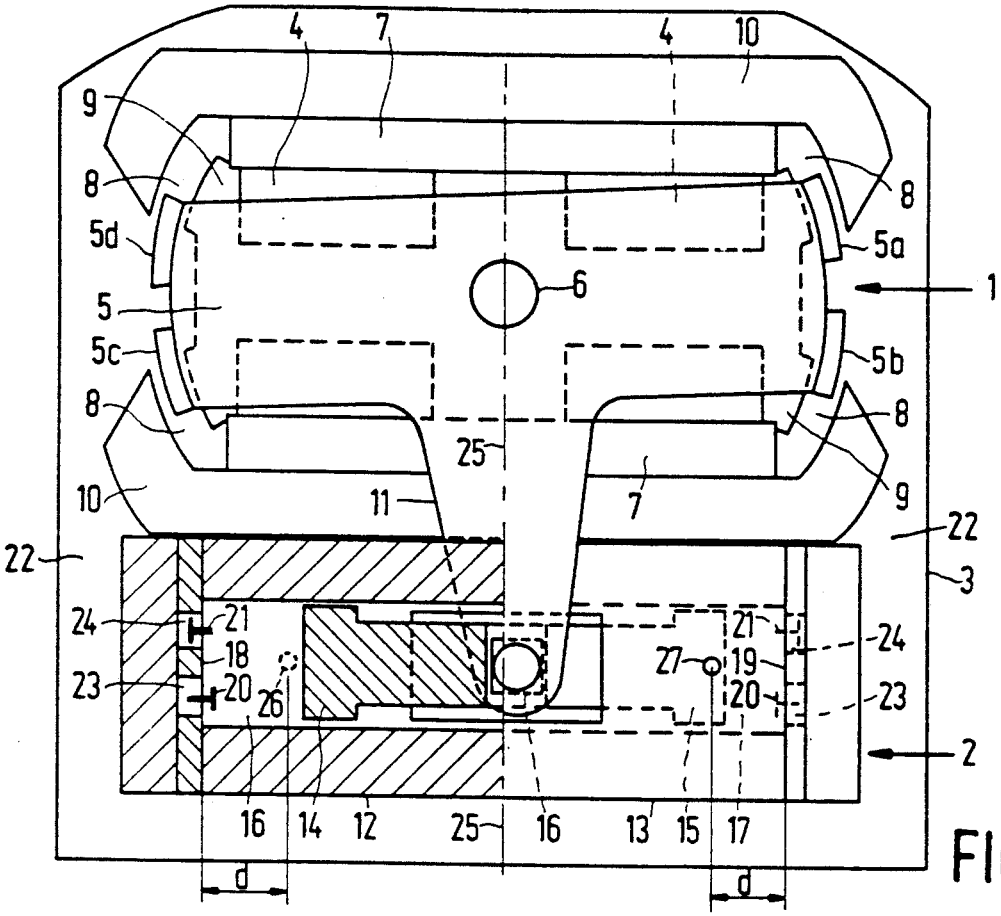
FIG. 1 shows a motor-compressor unit.

The motor-compressor unit shown in FIG. 1 comprises drive means in the form of a vibration motor 1 and a symmetrical twin free-piston compressor 2. The motor and the compressor are accommodated in a hermetically sealed housing 3. The operation of the motor-compressor is described in EP-A-0,155,057 and may be summarized as follows. An alternating current through the coils 4 of the vibration motor 1 results a rotary vibrational movement of the rotor 5 about the shaft 6. For each rotor section (5*a*, 5*b*, 5*c*, 5*d*) in the form of a sliding element the alternating magnetic field generated by the coils is superposed on the magnetic field produced by the permanent magnet 7. As result of this, the magnetic flux density in each rotor section alternately assumes a high and a low value. The coils have been wound in such a way relative to the direction of magnetisation of the permanent magnets that two diagonally opposed rotor sections (5*a*, 5*c*) experience a high magnetic flux density at the same instant, while the other two rotor sections (5*b*, 5*d*) experience a low flux density. This gives rise to a movement of the rotor sections in the air gaps 8 between the core 9 and the stator plates 10, where a high flux density exists. A reversal of the current direction will bring about a reversal of the movement of the rotor 5, thus resulting in a vibrational movement of the rotor. The compressor 2 comprises two cylinders 12, 13, in each of which one of two identical oppositely disposed pistons 14, 15 can perform a linear reciprocating movement. The pistons are integral with one another and in their center they are connected to an arm 11 of the vibrating rotor 5 by means of a coupling 16.

Alternately, medium is taken in, compressed and discharged by the pistons 14, 15 in the respective compression spaces 16, 17. For this purpose inlet and outlet valves 20, 21 are arranged in the cylinder end walls 19, 19. The motor-compressor is included in a refrigerating system, not shown, whose low-pressure section (suction side) is connected to a space 22 between the hermetically sealed housing 3 and the motorcompressor 1,2.

During a suction stroke medium is drawn directly from this space 22 into the compression spaces 16, 17 via inlet ports 23. During a compression stroke medium is forced to the high-pressure section (pressure side) of the refrigerating system via outlet ports 24 and a line, not shown.

In order to prevent the double piston 14, 15 from performing a reciprocating movement which is non-symmetrical relative to the centerline 25, drift reduction means are provided. The drift reduction means are comprised of each cylinder 12, 13 being formed with a duct 26, 27, which ducts each connect the compression spaces 16 and 17 respectively to the space 22 and which are each situated at an equal distance d from the respective cylinder end wall 18, 19. During each compression stroke a small amount of medium is first pressed into the space 22, where a suction pressure prevails, via a duct 26, 27, so that subsequently the pressure build-up in each cylinder takes place with the same swept volume. This ensures that the piston 14, 15 remains correctly centered.

Figure 2:
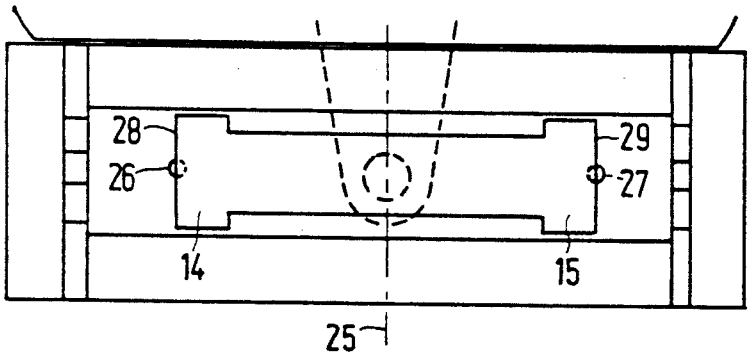
FIGS. 2 and 3 show the compressor of the unit of FIG. 1 in a center position of the piston and in a maximum extreme position respectively.
Figure 3:
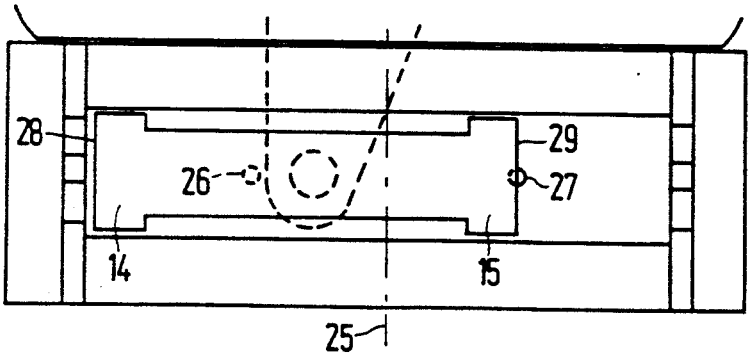

The limits imposed on the locations of the ducts are as follows. When the piston 14, 15 performs its minimal stroke (the piston is then in fact in the centre position), as is shown in FIG. 3, each duct is situated at the level of the end face 28, 29 of the piston. This is one limit. When the piston 14, 15 makes its maximal stroke, as illustrated in FIG. 2, each duct is situated at the level of the end face 28, 29 of the piston when this piston occupies a maximal extreme position at the end of a piston stroke. This is the other limit. Obviously, these limits are theoretical. In practice, the ducts will be situated somewhere between these limits and generally closer to the first-mentioned limit.

Satisfactory results have been obtained with a motor-compressor in which each duct 26, 27 is situated at the location of the respective end face 28, 29 of the piston when this piston has reached an extreme position at the end of a piston stroke and when the compressor has pumped a desired minimum amount of medium.

We claim:

1. A compressor, comprising:

a) a pair of oppositely disposed and fixably connected pistons each having a respective piston end face, b) respective cylinder portions in which each piston is reciprocable, said cylinder portions each comprising an end wall closing a compression space with a respective piston, said end walls each having an inlet valve connectable to an inlet source of a working medium and an outlet valve for exhausting said medium, said fixably connected pistons having a center position in which said pistons are equidistant from their respective end walls, and said pistons not being constrained to reciprocation about said center position; and c) means for reducing drift of said fixably connected pistons from said centerline during reciprocation, said means including a respective duct for connecting each compression space to the inlet source, said ducts being situated at equal distances from the respective cylinder end walls and closable by said pistons during reciprocation, each duct being situated at the location of the respective piston end face when said piston has reached an extreme position remote from its respective end wall at the end of a piston stroke and when the compressor has pumped a desired amount of working medium.

2. A compressor unit having a hermetically sealed housing enclosing a space, a symmetrical twin piston compressor within said housing, said compressor comprising two oppositely disposed and fixably connected identical pistons each having a respective piston end face, a respective cylinder portion in which each piston is reciprocable, each cylinder portion having an end wall closing a compression space with the respective piston and inlet and outlet valves in said end wall for selectively valving a working medium into and out of said compression space, said fixably connected pistons having a center position in which said piston end faces are equidistant from their respective end walls, a suction pressure prevailing in said sealed housing in the space between said compressor and said housing during reciprocation of said pistons, and a vibration motor having a rotationally oscillating drive shaft connected to said pistons for reciprocating said pistons in said cylinder portions, said drive means not constraining said pistons to reciprocation about said center position, wherein the improvement comprises:

drift reduction means for reducing drift of said pistons from said center position during reciprocation, said means including each cylinder having a duct connecting the respective compression space to said space between said housing and compressor where said suction pressure prevails, said ducts being situated at equal distances from the respective cylinder end walls and closeable by the respective pistons during reciprocation, each duct being situated at the location of its respective piston end face when said piston has reached an extreme position remote from its respective end wall at the end of a piston stroke and when the compressor has pumped a desired amount of working medium.

* * * * *